US007356299B2

(12) United States Patent
Kim et al.

(10) Patent No.: US 7,356,299 B2
(45) Date of Patent: Apr. 8, 2008

(54) FUSING ROLLER AND FUSING APPARATUS HAVING THE SAME

(75) Inventors: Hwan-guem Kim, Seoul (KR); Joong-gi Kwon, Gunpo-si (KR); Durk-hyun Cho, Suwon-si (KR); Young-min Chae, Suwon-si (KR); Sang-yong Han, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 134 days.

(21) Appl. No.: 11/211,579

(22) Filed: Aug. 26, 2005

(65) Prior Publication Data

US 2006/0045588 A1 Mar. 2, 2006

(30) Foreign Application Priority Data

Sep. 2, 2004 (KR) ..... 10-2004-0069997

(51) Int. Cl.
*G03G 15/20* (2006.01)

(52) U.S. Cl. ..... 399/330; 399/328

(58) Field of Classification Search ..... 399/328, 399/330, 333, 335, 338; 347/156; 219/216
See application file for complete search history.

(56) References Cited

U.S. PATENT DOCUMENTS

| | | | | |
|---|---|---|---|---|
| 5,752,150 | A * | 5/1998 | Kato et al. | 399/330 |
| 6,037,576 | A * | 3/2000 | Okabayashi et al. | 399/330 X |
| 6,340,810 | B2 * | 1/2002 | Yokoyama et al. | 399/328 X |
| 6,861,626 | B2 * | 3/2005 | Ogasawara et al. | 399/328 X |
| 7,009,158 | B2 * | 3/2006 | Sekiguchi et al. | 219/216 X |
| 2004/0101335 | A1 * | 5/2004 | Cho et al. | 399/330 |

* cited by examiner

*Primary Examiner*—Sandra L. Brase
(74) *Attorney, Agent, or Firm*—Roylance, Abrams, Berdo & Goodman, LLP

(57) ABSTRACT

A fusing roller and a fusing apparatus having the fusing roller are provided, wherein the fusing roller includes a coil unit, which generates resistive heat and an alternating magnetic flux in response to an alternating current input thereto, a heating roller unit, which generates an eddy current in response to the alternating magnetic flux and generates induced heat in response to the eddy current, and a contact unit, which is formed of a non-magnetic material in the fusing roller and which firmly contacts the coil unit with the heating roller unit.

14 Claims, 4 Drawing Sheets

FUSING ROLLER AND FUSING APPARATUS HAVING THE SAME

CROSS-REFERENCE TO RELATED APPLICATIONS

This application claims the benefit under 35 U.S.C. §119(a) of Korean Patent Application No. 10-2004-0069997, filed in the Korean Intellectual Property Office on Sep. 2, 2004, the entire disclosure of which is incorporated herein by reference.

BACKGROUND OF THE INVENTION

1. Field of the Invention

The present invention relates to a fusing apparatus. More particularly, the present invention relates to a fusing roller which maximizes the induced heating efficiency of a heating portion by making the heating unit firmly contact an object to be heated and then concentrating magnetic flux on the object to be heated, and a fusing apparatus having the fusing roller.

2. Description of the Related Art

In general, electrophotographic image forming apparatuses, such as laser printers or digital copiers, print a unicolored or multicolored image by applying light to a photosensitive medium charged with predetermined potentials to form a latent electrostatic image on the photosensitive medium, enabling a developer to develop the latent electrostatic image with a predetermined color of toner, transferring the developed toner image to a sheet of paper, and then fusing the transferred image onto the sheet of paper.

Electrophotographic printing apparatuses are classified as either wet-type electrophotographic printing apparatuses or dry-type electrophotographic printing apparatuses according to the type of developing agent that they use. Wet-type electrophotographic printing apparatuses use a developing agent in which toner particles are diffused into a liquid carrier, whereas dry-type electrophotographic printing apparatuses use a homogenous developing agent which is comprised of toner particles, or a heterogeneous developing agent which is a mixture of carrier particles and toner particles.

FIG. 1 is a latitudinal cross-sectional view schematically illustrating a conventional fusing apparatus 10 using a halogen lamp as a heat source, and FIG. 2 is a longitudinal cross-sectional view of the conventional fusing apparatus of FIG. 1, taken along line I-I" of FIG. 1. Referring to FIGS. 1 and 2, the fusing apparatus 10 includes two fusing rollers 11 and 12, which are formed as aluminum cylinders. Both ends of each of the fusing rollers 11 and 12 are supported by bearings 14, and the fusing rollers 11 and 12 are installed to become in contact with each other along longitudinal directions thereof. A coating layer 13 is formed on the surface of each of the fusing rollers 11 and 12. The coating layer 13 forms a nip, via which heat is transferred from each of the fusing rollers 11 and 12 to a toner image 21 on a recording medium 20, and which helps each of the fusing rollers 11 and 12 to be easily detached from the toner image 21 fused onto the recording medium 20.

A heating portion 15 is installed at the center of each of the fusing rollers 11 and 12 and uses, as a heat source, a halogen lamp that emits heat when connected to an external power supply (not shown). The heating portion 15 is separated from the inner surface of each of the fusing rollers 11 and 12 by an empty space therebetween filled with air.

When a current supplied by the external power supply is applied to both ends of the heating portion 15, the heating portion 15 generates radiant energy. The radiant energy is transmitted to the inner surface of each of the fusing rollers 11 and 12 via air and is then converted into thermal energy passing through a light-heat conversion layer, which is formed of a black body. The thermal energy is then conducted to the nip, which is an interface between the fusing rollers 11 and 12, via the fusing rollers 11 and 12 and the coating layer 13, and is transmitted to the toner image 21 on the recording medium 20 so that the toner image 21 can be fused onto the recording medium 20 by the thermal energy.

However, the conventional fusing apparatus using such a halogen lamp as a heat source has the following disadvantages.

First, since a halogen lamp has a low thermal efficiency, a considerable amount of time is required for warming the halogen lamp until the temperature of the halogen lamp reaches a desired fusing temperature. Therefore, a user has to wait until the halogen lamp is heated to the desired fusing temperature and the conventional fusing apparatus becomes ready to print documents.

Second, since the halogen lamp is separated from the inner surface of each of the fusing rollers 11 and 12 by the empty space therebetween filled with air, heat emitted from the halogen lamp heats each of the fusing rollers 11 and 12 through radiation and passes through the fusing rollers 11 and 12 through conduction. Thus, the speed of transmitting heat from the halogen lamp to the fusing rollers 11 and 12 is relatively low, and the thermal efficiency of the conventional fusing apparatus is also low.

Accordingly, a need exists for a system and method for improving thermal transmission and efficiency in a fusing apparatus, while reducing the time required for warming the fusing apparatus to a target temperature.

SUMMARY OF THE INVENTION

The present invention substantially solves the above and other problems, and provides a fusing roller which can considerably reduce the time required for warming a fusing apparatus using both induced heat and resistive heat, and can enhance the thermal efficiency of a heating portion by making the heating portion firmly contact an object to be heated, and further provides a fusing apparatus comprising such a fusing roller.

According to an aspect of the present invention, a fusing roller is provided which fuses a toner image on a recording medium. The fusing roller comprises a coil unit, which generates resistive heat and an alternating magnetic flux in response to an alternating current input thereto, a heating roller unit, which generates an eddy current in response to the alternating magnetic flux and generates induced heat in response to the eddy current, and a contact unit, which is formed of a non-magnetic material in the fusing roller and firmly contacts the coil unit with the heating roller unit.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF THE EXEMPLARY EMBODIMENTS

Figure 1:
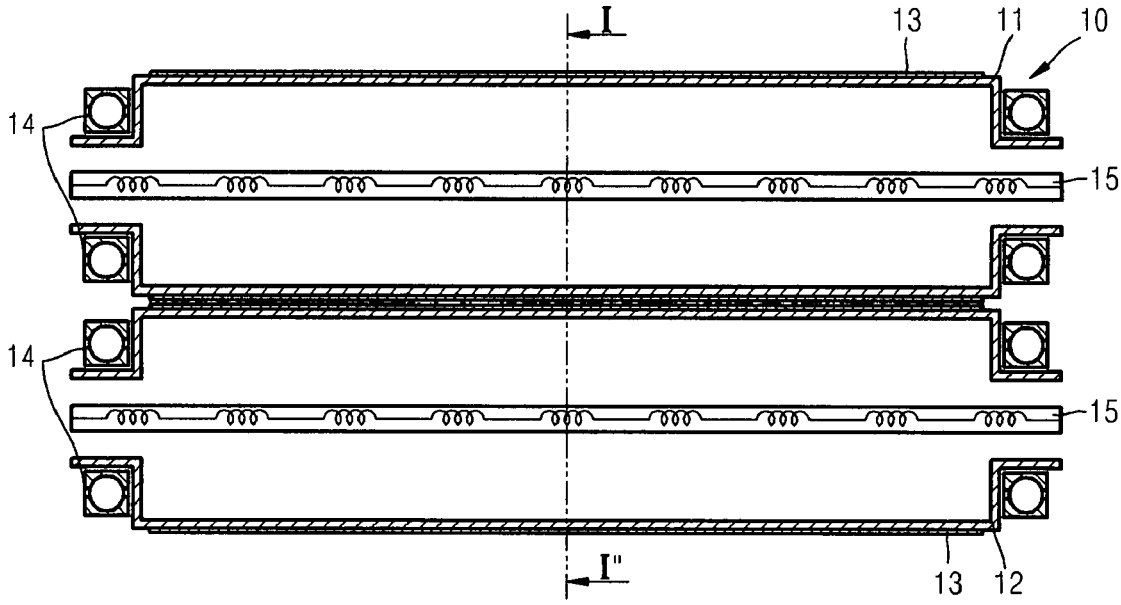
FIG. 1 (PRIOR ART)
FIG. 1 is a latitudinal cross-sectional view of a conventional fusing apparatus using a halogen lamp as a heat source.
Figure 2:
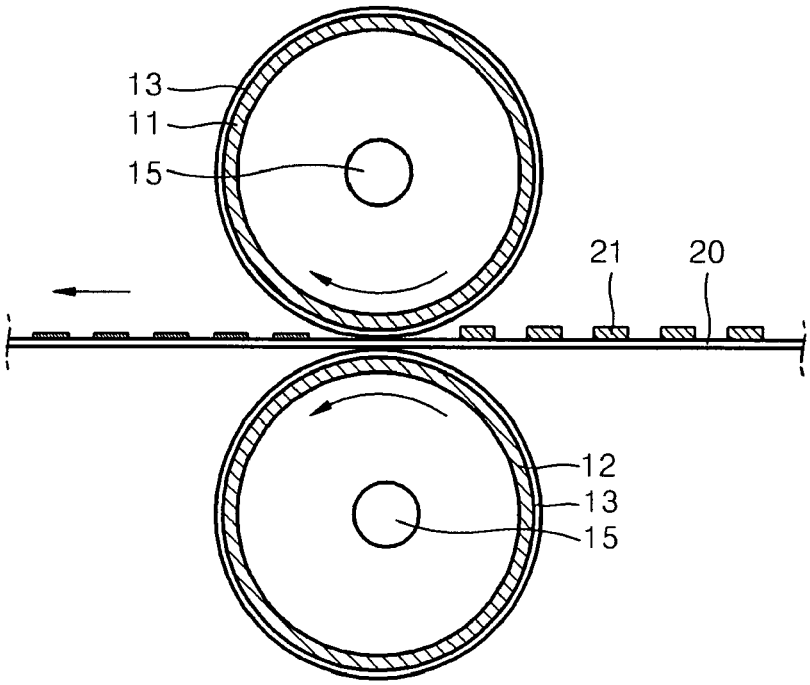
FIG. 2 (PRIOR ART)
FIG. 2 is a longitudinal cross-sectional view of the conventional fusing apparatus of FIG. 1, taken along line I-I" of FIG. 1.
Figure 3:
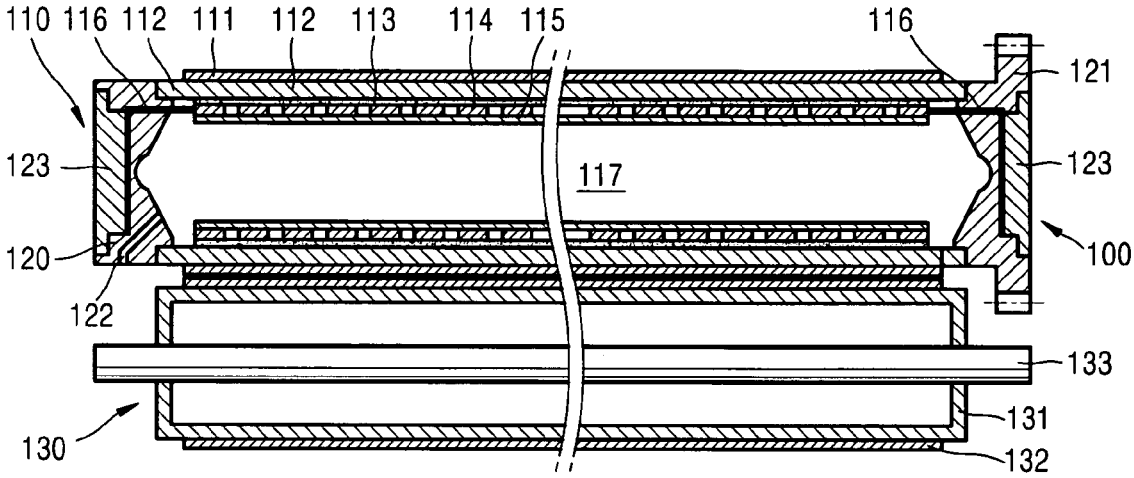
FIG. 3 is a latitudinal cross-sectional view of a fusing roller according to an exemplary embodiment of the present invention, and a fusing apparatus comprising the fusing roller according to an exemplary embodiment of the present invention.
Figure 4:
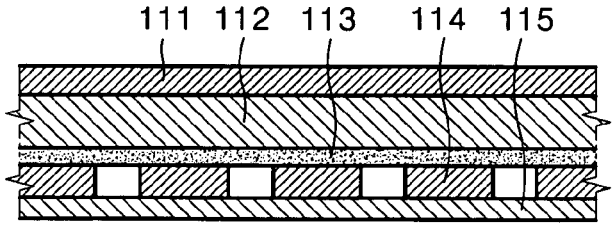
FIG. 4 is an enlarged view of a portion of the fusing roller of FIG. 3 according to an exemplary embodiment of the present invention.
Figure 6:
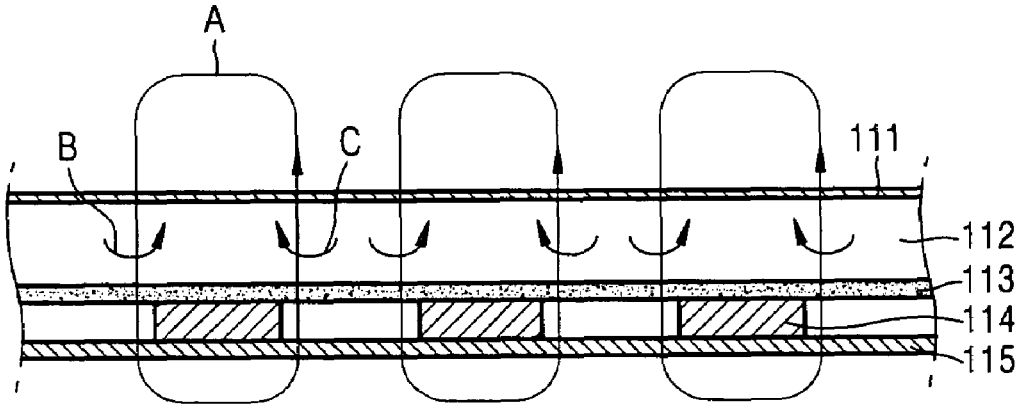
FIG. 6 is a cross-sectional view illustrating the generation of induced heat in a heating roller unit of FIG. 3 with the use of an eddy current according to an exemplary embodiment of the present invention.
Figure 7:
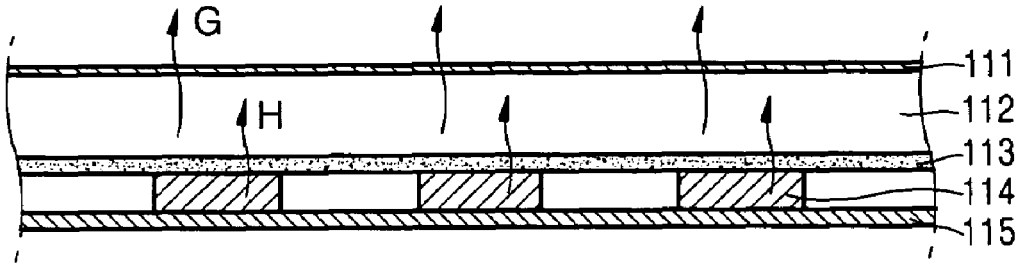
FIG. 7 is a cross-sectional view of a heat source of the fusing roller of FIG. 3 according to an exemplary embodiment of the present invention.

FIG. 3 is a latitudinal cross-sectional view of a fusing roller 110 according to an exemplary embodiment of the present invention, and a fusing apparatus 100 comprising the fusing roller 110 according to an exemplary embodiment of the present invention. FIG. 4 is an enlarged view of a portion of the fusing roller 110, FIG. 5 is a circuit diagram of a power supply unit 140 of the fusing roller 110, FIG. 6 is a cross-sectional view illustrating the generation of induced heat in the fusing roller 110 with the use of an eddy current, and FIG. 7 is a cross-sectional view of a heat source of the fusing roller 110.

Figure 5:
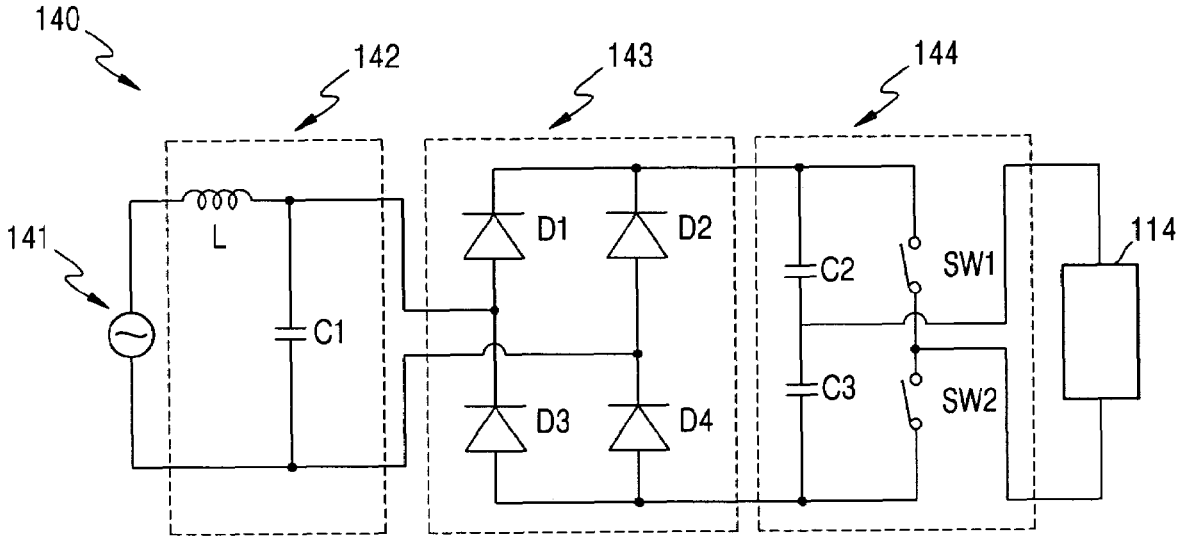
FIG. 5 is a circuit diagram of a power supply unit of the fusing roller of FIG. 3 according to an exemplary embodiment of the present invention.

Referring to FIGS. 3 through 5, the fusing apparatus 100 comprises the fusing roller 110, which generates heat that can be used to fuse a toner image (not shown) on a recording medium (not shown), and a press roller 130, which is installed to contact the fusing roller 110 along a longitudinal direction of the fusing roller 110 and presses the recording medium down on the fusing roller 110. Here, the recording medium passes through a nip between the fusing roller 110 and the press roller 130.

The press roller 130 is supported by an axial member 133 so that a body 131 of the press roller 130 can rotate about the axial member 133. Here, the body 131 of the press roller 130 is formed to have a shape substantially the same as a pipe. A coating layer 132 is formed on the outer circumferential surface of the body 131 in order to help the press roller 130 to be easily detached from the toner image after the toner image is fused on the recording medium. In yet other embodiments of the present invention, the fusing roller 110 may be formed to apply both heat and pressure to the recording medium, in which case, the press roller 130 is unnecessary.

The fusing roller 110 is comprised of a heating roller unit 112, a coil unit 114, a contact unit 115, and a power supply unit 140.

The heating roller unit 112 is formed of a resistive material to have a shape substantially the same as a pipe. A coating layer 111 is formed of, for example, tetrafluoruethylene, on the surface of the heating roller unit 112 so that the heating roller unit 112 can be easily detached from the toner image fused on the recording medium. Preferably, the heating roller unit 112 is formed of a material that is magnetized by a magnetic field and conducts current therethrough, such as iron alloy, copper alloy, aluminium alloy, nickel alloy, chrome alloy, or similar material, but is not limited thereto.

The coil unit 114 is arranged as a spiral on the inner surface of the heating roller unit 112 in firm contact with the inner surface of the heating roller unit 112. The coil unit 114 generates an alternating magnetic flux, which varies depending on the current input from the power supply unit 140. Preferably, the coil unit 114 is formed of a copper-based ribbon coil or similar material, but is not limited thereto.

An insulation layer 113 is interposed between the coil unit 114 and the heating roller unit 112, and is configured such that the insulation layer 113 is not broken down due to the alternating current input to the coil unit 114, and insulates the coil unit 114 from the heating roller unit 112 so that a leakage current is prevented from flowing into the heating roller unit 112.

Therefore, the insulation layer 113 should preferably have a high withstand voltage and high dielectric breakdown resistance. When the insulation layer 113 is configured to endure a high power supply voltage supplied from the outside of the fusing roller 110, the insulation layer 113 is considered to have a sufficiently high withstand voltage. When the insulation layer 113 generates a leakage current of less than 10 mA for one minute and does not break down dielectrically when a power supply voltage, which is not higher than the withstand voltage of the insulation layer 113, is applied to the fusing roller 110, the insulation layer 113 is considered to have a sufficiently high dielectric breakdown resistance. The insulation layer 113 may be formed of mica, polyimide, ceramic, silicon, polyurethane, glass, polytetrafluoroethylene, or similar material, but is not limited thereto.

The contact unit 115 is formed on the inner surface of the heating roller unit 112 to have a shape substantially the same as a pipe. The contact unit 115 applies expansive pressure on the coil unit 114 so that the coil unit 114 firmly contacts the insulation layer 113, and the insulation layer 113 firmly contacts the heating roller unit 112. The contact unit 115 is plastically deformable for applying expansive pressure to the coil unit 114, the insulation layer 113, and the heating roller unit 112, so that the coil unit 114, the insulation layer 113, and the heating roller unit 112 stay in firm contact with one another. That is, the contact unit 115 is used to assist in generating an induced current without any alternating magnetic flux loss by maximizing a coupling coefficient, which indicates how firmly the coil unit 114 is attached to the heating roller unit 112.

The contact unit 115 applies expansive pressure P to the inner circumference of the coil unit 114. When the expansive pressure P increases to a yield stress $\sigma\gamma$ of the material comprising the contact unit 115, the contact unit 115 is plastically deformed so that it does not return to its original shape. The expansive pressure P is expressed by the following Equation (1) below, $$P = \sigma \frac{t}{r} \tag{1}$$

wherein t and r are the thickness and diameter, respectively, of a pipe, that is, the thickness and diameter of the contact unit 115.

The coil unit 114 is firmly attached to the heating roller unit 112 by the contact unit 115 so that it rotates together with the heating roller unit 112.

The contact unit 115 is preferably formed of a non-magnetic material, such as polymer, rubber, or similar material, but is not limited thereto. Accordingly, an eddy current is not generated in the contact unit 115, but rather is generated in the heating roller unit 112 in response to an alternating magnetic flux generated by the coil unit 114. Due to the eddy current generated in the heating roller unit 112, resistive heat is generated. The resistive heat generated in the heating roller unit 112 is then used for fusing the toner image (not shown) on the recording medium (not shown), thus enhancing the fusing efficiency of the fusing roller 110.

The contact unit 115 is preferably formed to have a thickness of about 1 mm or less in order to minimize heat loss, but is not limited thereto.

Either end of the coil unit 114 is connected to a lead unit 116 so that the coil unit 114 is electrically connected to the power supply unit 140.

When an alternating current is input to the coil unit 114, an alternating magnetic flux is generated by the coil unit 114. The alternating magnetic flux generates an eddy current in the heating roller unit 112. Since the heating roller unit 112 has a resistance, it generates resistive heat in response to the generated eddy current.

An end cap 120 and a driving force transferring end cap 121 are respectively formed at both ends of the heating roller unit 112. The driving force transferring end cap 121 is substantially the same as the end cap 120 except that the driving force transferring end cap 121 includes a driving force transferring unit (not shown), such as a gear, which is connected to an electromotive apparatus (not shown) and rotates the fusing roller 110.

An air vent 122 is formed in the opposite end cap 120. The air vent 122 allows air access to an inner space 117 of the heating roller unit 112 so that the inner space 117 can be maintained at an atmospheric pressure.

Therefore, even when the heating roller unit 112 is heated by heat transferred from the coil unit 114, the inner space 117 of the heating roller unit 112 can be maintained at an atmospheric pressure because the inner space 117 is open to the atmosphere via the air vent 122. In yet another embodiment of the present invention, the air vent 122 may be formed in the driving force transferring end cap 121. Alternatively, in still another embodiment of the present invention, the air vent 122 may be formed in both the end cap 120 and the driving force transferring end cap 121.

An electrode 123 is installed at each of the end cap 120 and the driving force transferring end cap 121. The electrode 123 is electrically connected to the lead unit 116. A current supplied from an external power supply is transmitted to the coil unit 114 via the power supply unit 140, the electrode 123, and the lead unit 116.

Referring now to FIG. 5, the power supply unit 140 comprises a power supply portion 141, a line filtering portion 142, a rectifying portion 143, and a high frequency current generation portion 144.

The power supply portion 141 provides the coil unit 114 with an alternating current having a predetermined magnitude and frequency.

The line filtering unit 142 comprises an inductor L and a capacitor C1, and removes high frequency components from the alternating current received from the power supply portion 141. That is, the line filtering unit 142 smoothes the alternating current received from the power supply portion 141.

The rectifying portion 143 rectifies the alternating current, from which the high frequency components have been removed by the line filtering unit 142, thereby generating a direct current. The rectifying portion 143 may be a bridge rectifier comprised of four diodes D1, D2, D3, and D4, and which rectifies an alternating current into a direct current based on the polarization of the four diodes D1, D2, D3, and D4.

The high frequency current generation portion 144 receives the direct current from the rectifying portion 143 and generates an alternating current with a high frequency based on the received direct current. The high frequency current generation portion 144 comprises two capacitors C2 and C3, and two switches SW1 and SW2, and converts the direct current, obtained as a result of rectifying an alternating current, into an alternating current with a high frequency by selectively turning on or off one or both of the switches SW1 or SW2. In yet another embodiment of the present invention, a low frequency current generation portion may be used instead of the high frequency current generation portion 144. Additionally, in still another embodiment of the present invention, the power supply unit 140 may have a different structure from the one set forth herein, including variations to the structure and operation of one or more of the power supply portion, line filtering portion, rectifying portion, and frequency generation portion.

The generation of heat in the fusing roller 110 will now be described in greater detail with reference to FIGS. 3 through 7.

Referring to FIGS. 3 through 7, an alternating current is input from the power supply unit 140 to the coil unit 114, and the coil unit 114 generates an alternating magnetic flux A as marked by solid lines in FIG. 6. The alternating magnetic flux A is interlinked with the heating roller unit 112, thus generating eddy currents B and C of opposite directions in the roller unit 112. Here, it can be assumed that a current flows in the coil unit 114 from a downward direction to an upward direction.

Since the heating roller unit 112 has a resistance, heat (hereinafter referred to as induced Joule heat G) is generated in the heating roller unit 112 in response to the eddy currents B and C. The induced Joule heat G is transmitted to the toner image (not shown) via the coating layer 111 by the heating roller unit 112.

Since the coil unit 114 also has resistance, heat (hereinafter referred to as resistive Joule heat H) is generated by the coil unit 114 due to the alternating current input to the coil unit 114. The resistive Joule heat H is also transmitted to the toner image via the insulation layer 113, the heating roller unit 112, and the coating layer 111.

Therefore, when the alternating current is input to the coil unit 114, the resistive Joule heat H is generated by the coil unit 114 in response to the alternating current input to the coil unit 114 (and generates the magnetic flux A), and the induced Joule heat G is generated in the heating roller unit 112 in response to the eddy currents B and C generated by the alternating magnetic flux A. The resistive Joule heat H and the induced Joule heat G are then used to fuse the toner image onto the recording medium (not shown).

As described above, the fusing roller according to embodiments of the present invention has the following advantages. First, since a contact unit formed of a non-magnetic material firmly attaches a coil unit to a heating roller unit, it is possible to enhance the efficiency of the heating roller unit, in which induced heat is generated, by concentrating magnetic flux on the coil unit.

Second, since both resistive heat and induced heat are used to heat the heating roller unit, it is possible to considerably reduce the time required for warming the fusing roller to a target temperature.

Although a number of exemplary embodiments of the present invention have been shown and described, it can be appreciated by those skilled in the art that changes may be made in these embodiments without departing from the principles and spirit of the invention, the scope of which is defined in the following claims and their equivalents.

What is claimed is:

1. A fusing roller, for fusing a toner image on a recording medium, the fusing roller comprising:

a coil unit, for generating resistive heat and an alternating magnetic flux in response to an alternating current input thereto;

a heating roller unit, for generating an eddy current in response to the alternating magnetic flux and generating induced heat in response to the eddy current; and a contact unit, comprised of a non-magnetic material disposed in the fusing roller for providing an expansive pressure for firmly contacting the coil unit with the heating roller unit.

2. The fusing roller of claim 1, further comprising:

an insulation layer between the coil unit and the heating roller unit for separating the coil unit from the heating roller.

3. The fusing roller of claim 1, wherein the coil unit is configured to receive at least one of a low frequency alternating current or a high frequency alternating current.

4. The fusing roller of claim 1, wherein the heating roller unit is comprised of at least one of a copper alloy, aluminum alloy, nickel alloy, iron alloy, and chrome alloy material.

5. The fusing roller of claim 1, wherein the contact unit is configured such that, when the expansive pressure is applied by the contact unit, the contact unit is plastically deformed so that it firmly contacts the coil unit with an inner surface of the heating roller unit.

6. The fusing roller of claim 1, wherein the contact unit is formed to have a thickness of about 1 mm or less.

7. The fusing roller of claim 1, further comprising:

a power supply unit, for generating at least one of a low frequency alternating current or a high frequency alternating current.

8. A fusing apparatus, comprising:

a fusing roller as claimed in claim 1; and a press roller, which is installed to face toward and contact the fusing roller for pressing the recording medium toward the fusing roller.

9. A fusing roller, for fusing a toner image on a recording medium, the fusing roller comprising:

a coil unit, for generating resistive heat and an altemating magnetic flux in response to an alternating current input thereto; and a heating roller unit, for generating an eddy current in response to the alternating magnetic flux and generating induced heat in response to the eddy current, wherein the coil unit rotates together with heating roller unit; and a contact unit, comprised of a non-magnetic material disposed in the fusing roller for providing an expansive pressure for firmly contacting the coil unit with the heating roller unit.

10. The fusing roller of claim 9, wherein the contact unit is configured such that, when the expansive pressure is applied by the contact unit, the contact unit is plastically deformed so that it firmly contacts the coil unit with an inner surface of the heating roller unit.

11. The fusing roller of claim 9, wherein the contact unit is formed to have a thickness of about 1 mm or less.

12. A method for fusing a toner image on a recording medium, comprising the steps of:

generating resistive heat and an alternating magnetic flux from a coil unit in response to an alternating current input thereto;

generating an eddy current in a heating roller in response to the alternating magnetic flux and generating induced heat in the heating roller in response to the eddy current; and providing an expansive pressure for minimizing a distance between the coil unit and the heating roller to maximize transfer of the resistive heat from the coil unit to the heating roller and maximize production of the induced heat in the heating roller.

13. The method of claim 12, further comprising the step of electrically insulating the coil unit from the heating roller unit.

14. The method of claim 12, further comprising the step of applying at least one of a low frequency alternating current or a high frequency alternating current to the coil unit.

* * * * *